US009793612B1

(12) United States Patent
Siripuram

(10) Patent No.: US 9,793,612 B1
(45) Date of Patent: Oct. 17, 2017

(54) REDUCED PROFILE LEAKY-WAVE ANTENNA

(71) Applicant: Anirudha Siripuram, San Diego, CA (US)

(72) Inventor: Anirudha Siripuram, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 677 days.

(21) Appl. No.: 13/941,579

(22) Filed: Jul. 15, 2013

(51) Int. Cl.
*H01Q 11/08* (2006.01)
*H01Q 9/28* (2006.01)

(52) U.S. Cl.
CPC ..... *H01Q 11/08* (2013.01); *H01Q 9/28* (2013.01)

(58) Field of Classification Search
CPC ..... H01Q 11/08
See application file for complete search history.

(56) References Cited

U.S. PATENT DOCUMENTS 4,442,438 A * 4/1984 Siwiak ..... H01Q 9/27 343/792
5,329,287 A * 7/1994 Strickland ..... H01Q 11/08 343/752
5,652,598 A * 7/1997 Campbell ..... H01Q 9/16 343/752
6,169,523 B1 * 1/2001 Ploussios ..... H01Q 1/36 343/802
2012/0268336 A1 * 10/2012 Kitano ..... H01Q 11/08 343/790

* cited by examiner

*Primary Examiner* — Robert Karacsony
*Assistant Examiner* — Amal Patel
(74) *Attorney, Agent, or Firm* — SSC Pacific Patent Office; Arthur K. Samora; Kyle Eppele

(57) ABSTRACT

A reduced profile leaky-wave antenna and methods for manufacture therefor can include an inner conductor and an outer conductor. The outer conductor can be arranged in a coaxial relationship around the inner conductor to define an annular waveguide. A helical aperture can be formed in the outer conductor, to establish a leaky-wave antenna configuration. The helical aperture can have a helical pitch, which can be chosen according to the desired physical length of the antenna. For monopole reduced profile leaky-wave antennas, a metallic disk can optionally be placed the distal end of the antenna. For dipole reduced profile leaky-wave antenna embodiments, a metallic disk can be place at both ends of the antenna. The devices and methods of the present invention have the added advantage of allowing for the same feed structure to be used for both monopole antennas and dipole antennas.

4 Claims, 9 Drawing Sheets

REDUCED PROFILE LEAKY-WAVE ANTENNA

FEDERALLY-SPONSORED RESEARCH AND DEVELOPMENT

This invention (Navy Case No. 102274) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-5118; email ssc_pac_T2@navy.mil.

FIELD OF THE INVENTION

The present invention pertains generally to antennas. More particularly, the present invention pertains to quarter-wave or half-wave monopole and dipole antennas (and methods for designing such antennas) that are significantly smaller than their prior art counterparts, but without sacrificing bandwidth, gain, and radiation patterns of such devices.

BACKGROUND OF THE INVENTION

Monopole and dipole antennas are well-known in the prior art. For such antennas, it is often desirable to improve upon the portability aspect of such antennas (i.e., make the antenna smaller) without significantly degrading antenna performance. In the case of dipole antennas, it may be desirable to design the antenna so that it has a feed structure that is identical to the feed structure of a monopole antenna. This can allow for a simpler means of balancing the feed.

A candidate antenna element that could satisfy these requirements while allowing for a reduction in antenna height could be a resonant-cavity leaky-wave antenna. An advantage of a resonant-cavity leaky-wave monopole (or dipole) antenna can be that the input impedance of the antenna can be highly dependent on the input impedance of the cavity. In the case that the cavity is a terminated waveguide, this impedance is largely a function of the characteristic impedance of the waveguide. The design challenge can then be to efficiently couple energy from the feed structure into the cavity and then to leak that energy out of the cavity through the aperture(s). Additionally, the aperture could be designed such that the induced leakage current radiates energy as would a standard monopole (or dipole). The proposed design methodology can allow an antenna designer to ensure both these requirements are satisfied.

In view of the above, it is an object of the present invention to provide a leaky-wave antenna that is significantly smaller than its prior art counterpart, but without sacrificing the bandwidth, gain, and radiation patterns of the antenna. Another object of the present invention is to provide a leaky-wave antenna that can allow the same feed structure for both monopole and dipole antenna. Yet another object of the present invention is to provide a leaky-wave antenna that is electrically short relative to its prior art counterparts. Still another object of the present invention is to provide a leaky-wave antenna with a design methodology that can be frequency scalable, which can allow for easy design modifications if the desired operating parameters of the antenna are changed. Yet another object of the present invention is to provide a leaky-wave antenna that is easy to manufacture in a cost-effective manner.

SUMMARY OF THE INVENTION

A reduced profile leaky-wave antenna and methods for manufacture therefor can include an inner conductor and an outer conductor. The outer conductor can be arranged in a coaxial relationship around the inner conductor to define an annular waveguide. A helical aperture can be formed in the outer conductor, to establish a leaky-wave antenna configuration. The helical aperture can have a helical pitch, which can be chosen according to the desired physical length of the antenna.

The inner conductor and outer conductor can be made of a copper material. The reduced profile leaky-wave antenna can be a monopole antenna or a dipole antenna. For monopole antenna, a metallic disk can optionally be placed the distal end of the antenna. For dipole antenna embodiments, a metallic disk can be place at both ends of the antenna. The devices and methods of the present invention have the added advantage of allowing for the same feed structure to be used for both monopole antennas and dipole antennas.

BRIEF DESCRIPTION OF THE DRAWINGS

The novel features of the present invention will be best understood from the accompanying drawings, taken in conjunction with their accompanying descriptions, in which similarly-referenced characters refer to similarly-referenced parts, and in which.

DETAILED DESCRIPTION OF THE EMBODIMENTS

Figure 1:
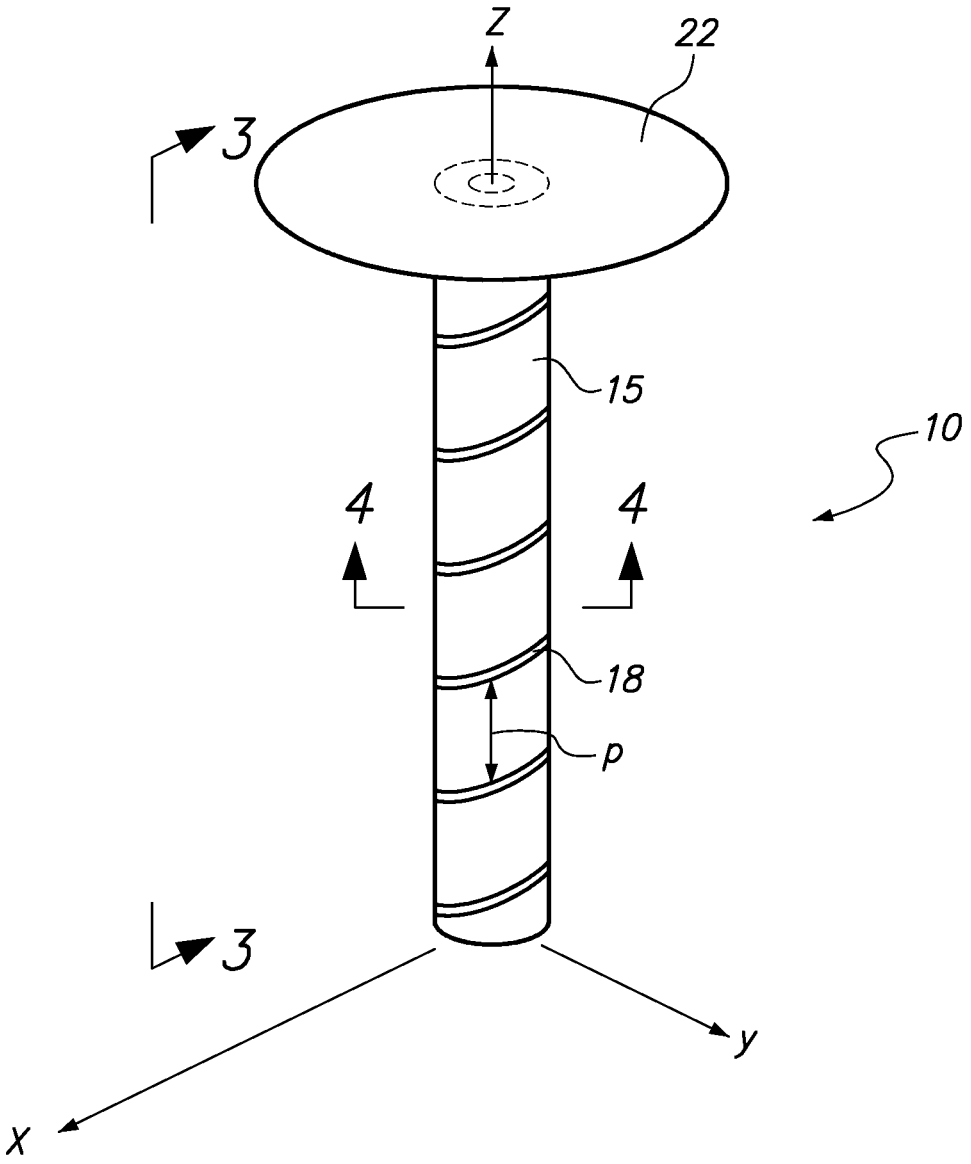
FIG. 1 is a side-elevational view of a reduced profile leaky-wave antenna according to several embodiments of the present invention.
Figure 2:
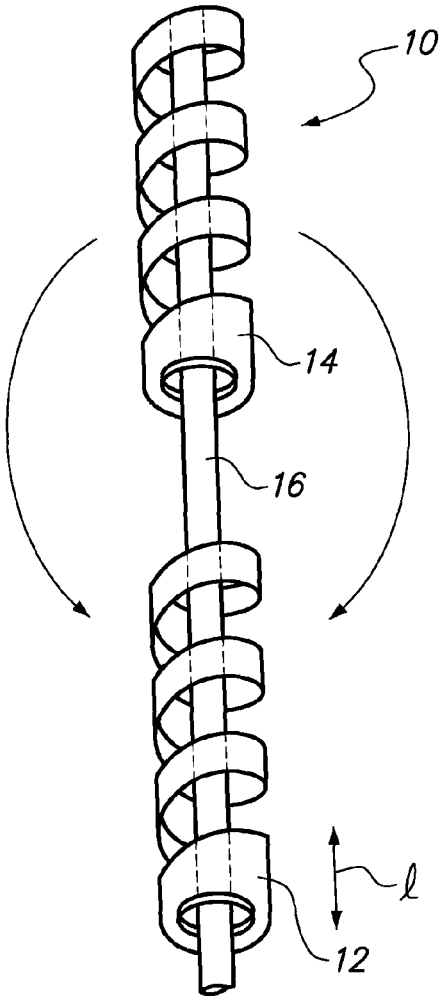
FIG. 2 is an exploded side-elevational view of the antenna of FIG. 1.
Figure 3:
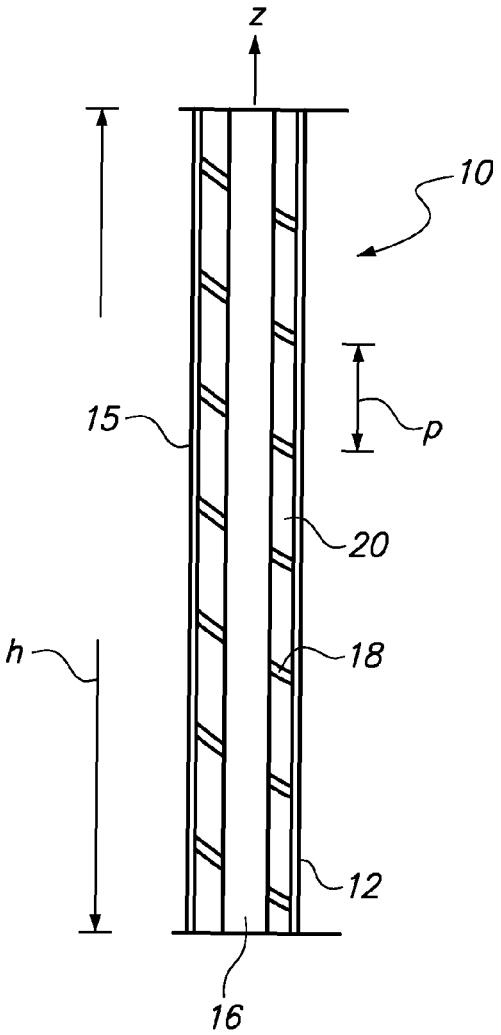
FIG. 3 is a cross-sectional view taken along line 3-3 of FIG. 1.

Referring initially to FIGS. 1-4, a reduced profile leaky-wave antenna can be shown and can be generally designated by reference character 10. As shown, antenna 10 can include an outer conductor 15, which can surround an inner conductor 16 in a coaxial relationship. Outer conductor can further be formed with a helical slot 18. Or, first helical strip 12 and second helical strip 14 can be arranged around inner conductor 16, and in a slightly spaced-apart fashion, to function as outer conductor 15 with helical slot 18 (This configuration can be best seen in FIG. 2). Helical slot 18 can have a pitch "p", as shown in FIGS. 1 and 3. The manner in which helical pitch p can be manipulated according to the user's needs can be described more fully below.

Figure 4:
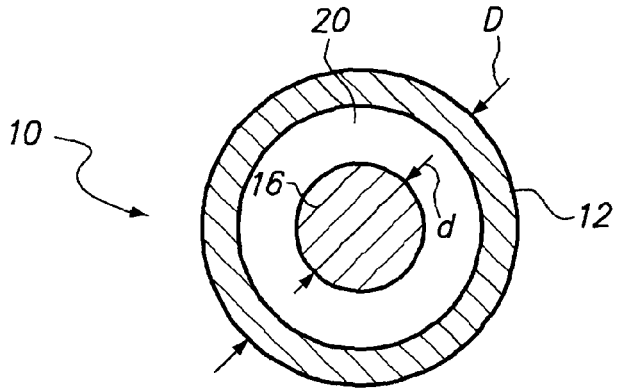
FIG. 4 is a cross-sectional view taken along line 4-4 of FIG. 1.
Figure 5:
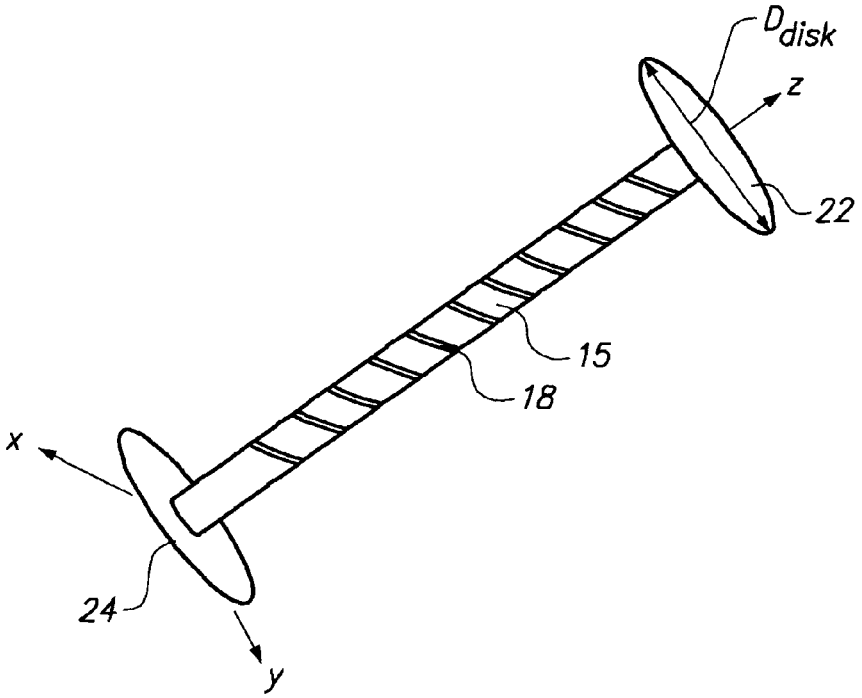
FIG. 5 is a side-elevational view of a reduced profile leaky-wave antenna according to several alternative embodiments of the present invention.

As shown in FIGS. 3-4, the inner conductor can have an inner diameter d, while outer conductor can have an outer diameter D. For several embodiments where antenna 10 is a monopole antenna, and as shown in FIG. 1, a first conductive disk 22 can be fixed to the distal end of the antenna. For other alternative embodiments where antenna 10 is a dipole antenna, a first conductive disk 22 and second conductive disk 24 can be placed at the ends of the antenna. This configuration is illustrated in FIG. 5.

From FIGS. 3-4, it can be seen that inner conductor 16 and outer conductor 15 can cooperate to form an annular waveguide cavity 20. Waveguide cavity 20 can be considered to be a terminated coaxial waveguide which can retain the cylindrical shape characteristic of most monopole/dipole antennas. The characteristic impedance of a coaxial waveguide can readily be dictated by proper sizing of the inner conductor diameter d and outer conductor diameter D. The helical slot 18 can be a continuous spiral slot on the outer conductor of the coaxial waveguide.

Referring back to FIG. 1, due to the spiral discontinuity imposed on antenna 10 by helical slot 18, the assumed current distribution, the leakage current, on the outer surface of the outer conductor should follow a spiral path along the length of the waveguide. Assuming the outer conductor diameter is electrically small, the contribution to the radiated field by the rotational component of this current should cancel itself out. In this case, the radiated field predominantly results from the axial (along the z-axis in FIG. 1) component of the leakage current.

Figure 6:
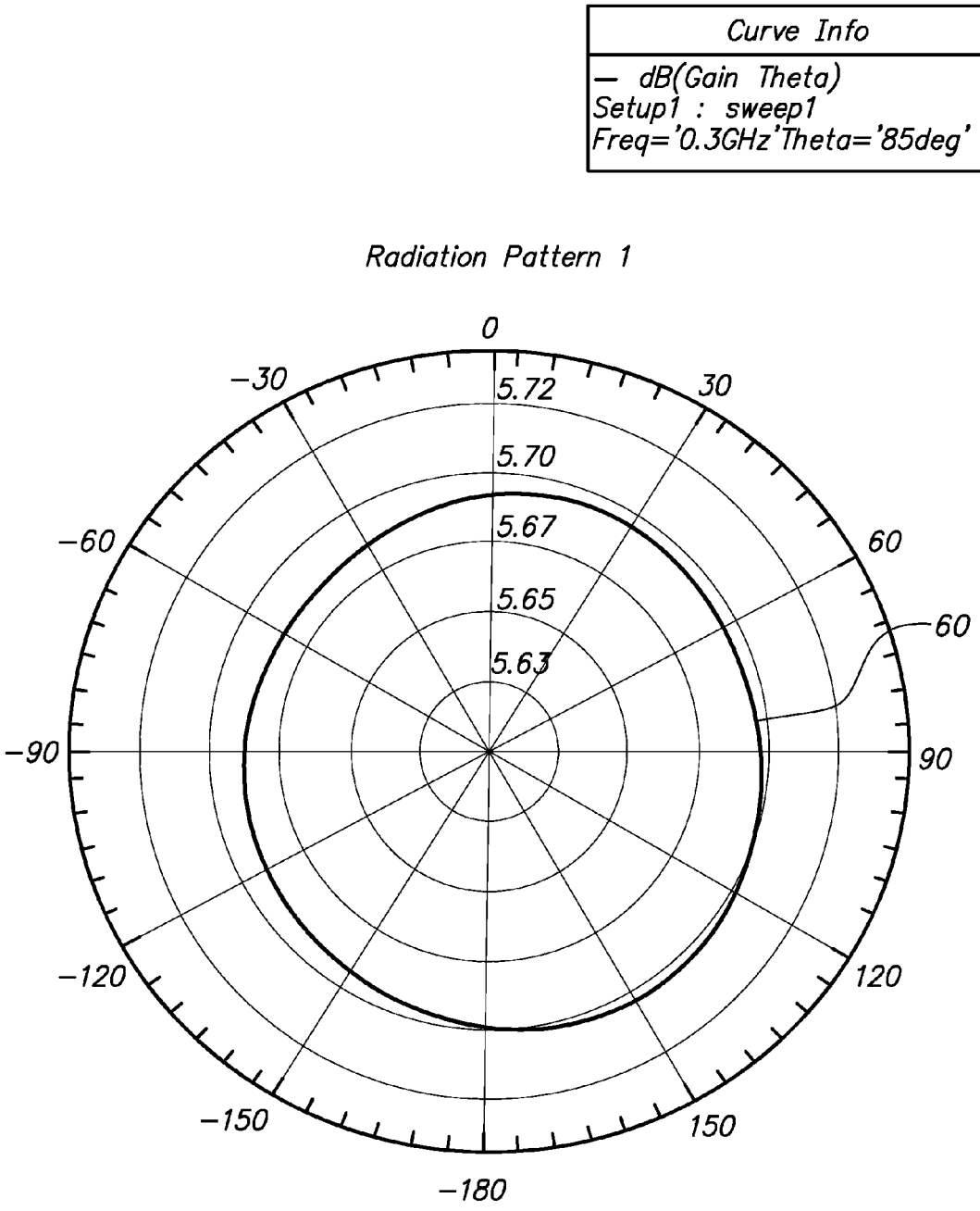
FIG. 6 is an azimuthal gain pattern for antenna of FIG. 1, when viewed in top plan.
Figure 11:
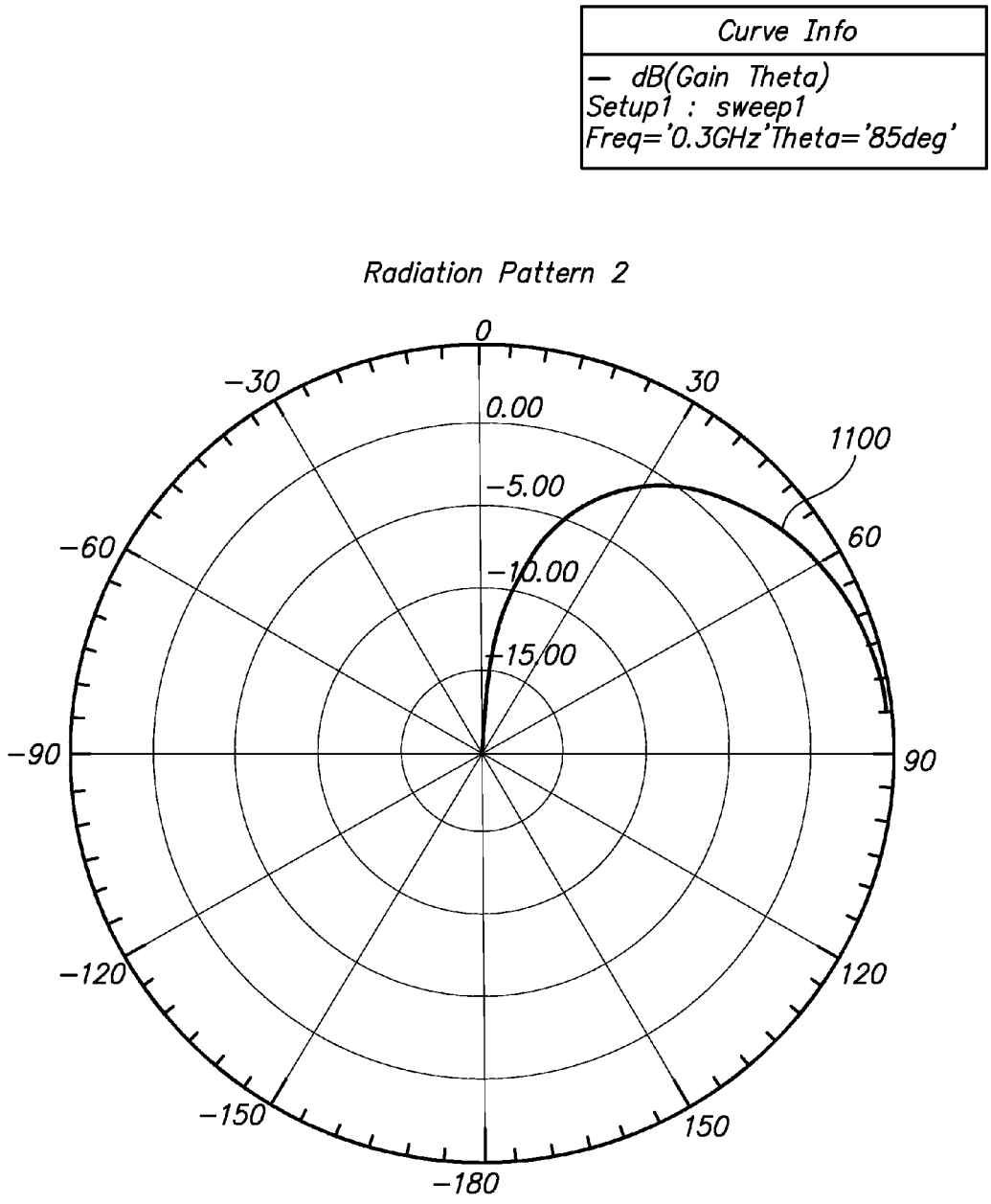
FIG. 11 is a gain pattern for antenna of FIG. 1, when viewed in side elevation; and, FIG. 12 is a gain pattern for antenna of FIG. 1, when viewed in side elevation.

FIGS. 1 and 3 can illustrate an example of a λ/8-height (300 MHz) short-circuited monopole antenna. The azimuthal cut of the radiation patterns generated by the monopole (when viewed in top plan) can be illustrated by curve 60 in FIG. 6. Similarly, the gain patterns for this embodiment when viewed in side elevation can be seen from the curve 1100 in FIG. 11. From FIGS. 6 and 11, it can be seen that the $E_\theta$ (vertical component) gain pattern is omnidirectional and shows a gain of nearly 5 dBi. The $E_\phi$ (horizontal component) is negligibly small and the pattern does retain the characteristic axial null. The gain pattern 60 in FIG. 6 provides no information about impedance mismatch; however, it does show that such a radiating element can be driven to excite leakage current that radiates in the same way as a monopole of the prior art.

A. Numerical Design Method

Before describing the methods according to several embodiments, it can be useful to first identify the potential design parameters for such an antenna 10. If one assumes that features such as metal thickness and slot width are set by practical limitations, then possible design parameters can include waveguide length "h" (see FIG. 3), outer conductor diameter D, inner conductor diameter d, inner/outer conductor ratio (d/D, see FIG. 4), conductor material, waveguide region material properties (air, vacuum, or a dielectric materials such as a Teflon® material), helical slot pitch "p", offset distance "l" (FIG. 2), helical slot length, and waveguide termination (i.e. short, open, etc.), as well as metallic disk diameter $D_{disk}$ in the cases where a metallic disk 22 is used (see FIG. 5). The objective of the design methodology can be to allow for a direct correlation between modifications in the design parameters and antenna performance.

Figure 9:
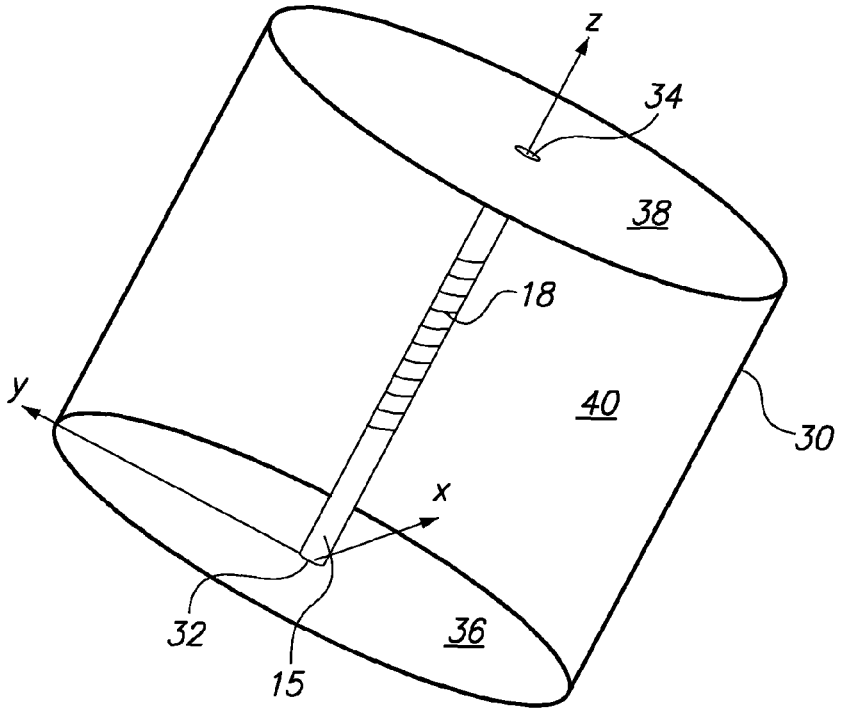
FIG. 9 is a diagram of a two waveguide system for simulating the performance of the antenna of FIG. 1.

As stated above, the predominant contribution to the radiated field can be presumed to be made by the axial component of the leakage current. Therefore, it would be useful to characterize the relationship between this component of the leakage current and a modal excitation of the coaxial waveguide. One way to do this is to numerically analyze a portion of the antenna 10 as part of a larger two-waveguide analysis system. An example of such a two-waveguide analysis system is shown in FIG. 9. As shown in FIG. 9, outer conductor 15 can function as the "inner conductor" for a larger simulation conductor 30. The area between outer conductor 15 and simulation conductor 30 can be thought of as the simulation waveguide 40. The inner and outer conductor diameter d/D for the smaller waveguide can be determined by the desired characteristic impedance of that waveguide and practical limitations such as the availability of conductor dimensions. Ideally, the characteristic impedance would be the desired input impedance of the antenna element at resonance (typically 50Ω). The simulation conductor 30 can be assumed to be a perfect electrical conductor, or PEC. The dimensions of the simulation waveguide 40 can be sized so that lowest-order TEM mode (A transverse electromagnetic, TEM, mode is a mode wherein neither the electric nor the magnetic field is in the direction of propagation) is the only propagating mode that the simulation waveguide 40 can support over the design frequency range of interest. This TEM mode is meant to approximate the axial component of the leakage current on the outer conductor 15 that is under simulation.

Analysis of the two-waveguide system and subsequent design of the leaky-wave element can be done by first defining 4 ports, 32, 34, 36 and 38, which can be seen in FIG. 9. In this case, since both the simulation conductor 30 is being simulated and simulation waveguide 40 can be sized to only support one propagating mode through antenna 10, and since only a section of the antenna is being analyzed, an additional waveguide length should allow the evanescent modes generated by the spiral slot 18 to decay such that excitation and termination of only the lowest-order mode is sufficient to characterize the desired electromagnetic phenomena.

Figure 10:
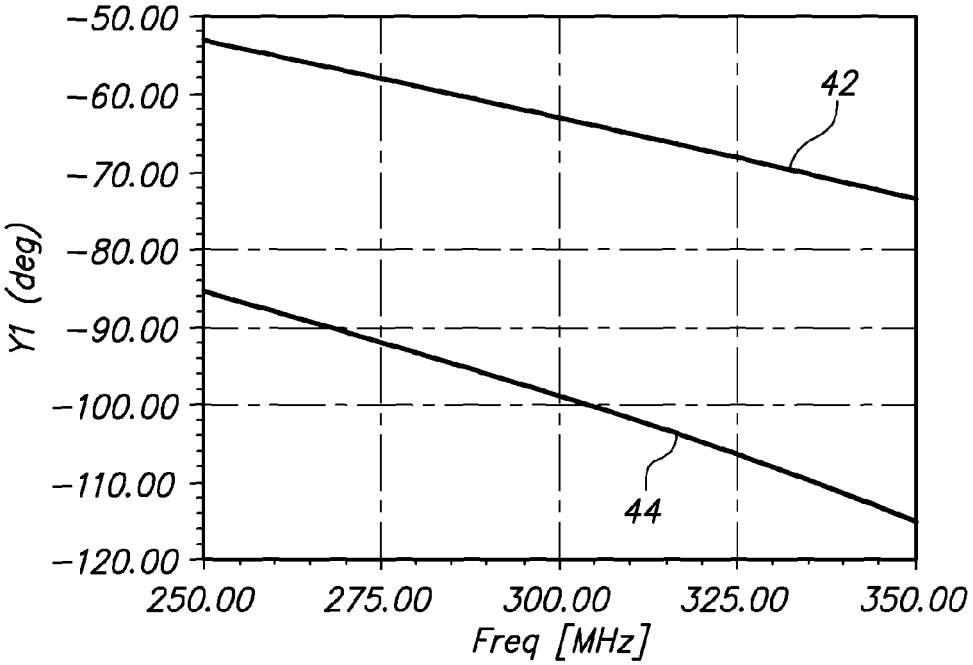
FIG. 10 is a graph of the simulation results of FIG. 9.

The simulation setup shown in FIG. 9 is of a two-waveguide system where the helical slot 18 discontinuity has an actual length of 14 cm (axial length of the spiral slot 18 is 12 cm). The slot width of helical slot 18 is 2 mm. The conductor material for the slotted outer conductor 15 and the inner conductor 16 (not shown in FIG. 9) of the smaller waveguide is copper. The material medium for both waveguides (waveguide 20, not shown in FIG. 9) and simulation waveguide 40 between outer conductor 15 and simulation conductor 30 is left as air. The slot width of helical slot 18 is 2 mm. The important considerations for this simulation are the phase relationships between ports 32 and 34, and ports 36 and 38, since they give an indication of the phase variation (along the axial direction) of the currents on the outside and inside of the spiral slotted conductor. A pitch angle for helical slot 18 was chosen to achieve a phase variation of approximately 90° at 270 MHz. In this case, the physical length of the waveguide is roughly λ/8 or 45°. Results of the simulation, shown in can be seen in FIG. 10 (line 42 in FIG. 10 corresponds to ports 32 and 34, which line 44 corresponds to ports 36 and 38) and Table 1 below:

TABLE 1

| Waveguide Phase Variation | | | |
|---|---|---|---|
| | Freq [MHz] | cang_deg(S(4,3)) [deg] Setup1: Sweep1 | cang_deg(S(2,1)) [deg] Setup1: Sweep1 |
| 1 | 250.000000 | −85.469417 | −53.308064 |
| 2 | 255.000000 | −86.756532 | −54.260275 |
| 3 | 260.000000 | −88.053499 | −55.216283 |
| 4 | 265.000000 | −89.361785 | −56.176449 |
| 5 | 270.000000 | −90.682884 | −57.141126 |
| 6 | 275.000000 | −92.018326 | −58.110662 |
| 7 | 280.000000 | −93.369688 | −59.085407 |
| 8 | 285.000000 | −94.738600 | −60.065720 |
| 9 | 290.000000 | −96.126764 | −61.051972 |
| 10 | 295.000000 | −97.535959 | −62.044546 |
| 11 | 300.000000 | −98.968058 | −63.043842 |
| 12 | 305.000000 | −100.425042 | −64.050277 |
| 13 | 310.000000 | −101.909018 | −65.064282 |
| 14 | 315.000000 | −103.422234 | −66.086297 |
| 15 | 320.000000 | −104.967103 | −67.116772 |
| 16 | 325.000000 | −106.546217 | −68.156156 |
| 17 | 330.000000 | −108.162377 | −69.204892 |
| 18 | 335.000000 | −109.818612 | −70.263409 |
| 19 | 340.000000 | −111.518206 | −71.332113 |
| 20 | 345.000000 | −113.264726 | −72.411377 |
| 21 | 350.000000 | −115.062047 | −73.501534 |

Table 1 can reveal that the mode that sets up in the interior waveguide (the middle column) can have a much larger phase variation (approximately a 50% larger phase slope) than the mode of the exterior waveguide (the right column of Table 1). The mode set up in the interior waveguide will be referred to as the "matching mode" because the waveguide dimension will be chosen to improve the input match. The mode set up in the exterior waveguide will be referred to as the "leaky mode" for the obvious reason. The plot of the phase variations (FIG. 10) illustrates that for the chosen parameters of this simulation, both retain a linear relationship between phase and frequency is maintained, which can indicate that the analysis of the spiral slot discontinuity using TEM modes of the inner and outer waveguides is still reasonable across the frequency range of interest. It was found that making the spiral pitch distance too small can result in phase variation that is not linear in frequency.

B. Monopole Example

Using the numerical design methods according to several embodiments that are described above, and continuing with the example from above, in order to design a monopole element, one should first decide the desired resonant frequency, the monopole height, and reasonable radial dimensions for the inner and outer conductors. For this example, a design resonant frequency can be chosen to be 300 MHz (for a 300 MHz antenna, the antenna height would normally be λ/4, or about twenty-five centimeters, 25 cm), the monopole manufactured height "h" can be 13 cm, and radial dimensions of inner and outer conductors can be 0.125" (d=0.25") and 0.3125" (D=0.625"), respectively. The slot pitch p can be chose to be nineteen millimeters (19 mm), and a one centimeter (1 cm) offset distance "l" (See FIG. 2) can be chosen. An infinite ground plane can be assumed, and a diameter of disc 22 $D_{disk}$ can be chosen to be around 3.18 inches. Within these parameters (See line 5 of Table 1), the slotted coaxial waveguide can be designed so that an effective phase variation, across its length, of about 90° can be seen at 300 MHz. Under such a condition, the waveguide can be shorted at the terminating end, which can result in an effective λ/4 shorted cavity for the matching mode.

The ratio of conductor d/D, assuming that waveguide 20 is a vacuum, can result in a characteristic impedance of approximately 55Ω (antenna 10 can be assumed to be fed with a 50Ω line). As mentioned earlier, the phase-slope of the matching mode can be significantly greater than that of the leaky mode. Therefore, the leakage current cannot be shorted at the same length as the waveguide current. It is not desirable to extend the length of the slotted conductor to accommodate this undesirable condition. One compromise could be to top-load the waveguide 20 by fixing a metallic circular disk 22 to the distal end of antenna 10, as shown in FIG. 1. Top-loading the waveguide 20 with a metallic circular disk 22 may require some modification of the waveguide pitch distance "p", in order to retain the desired resonant frequency but not at a cost of increasing antenna height "h".

The impedance of the antenna 10 can be compared to an ideal λ/4 thin monopole from which it should be apparent that the leaky-wave design did not significantly improve on the bandwidth of the λ/4 monopole. However, one must keep in mind that the leaky-wave monopole is nearly half of the size of a standard monopole. Stated differently, antenna 10 can have substantially the same bandwidth as an ideal λ/4 thin monopole, but at up to half the physical size. Additionally, the characteristic impedance was arbitrarily chosen to be close to 50Ω. The described design methodology allows one to incorporate a characteristic impedance mismatch to potentially improve broadband performance. As disclosed above, the near azimuth (85°) radiation pattern (θ-polarized) at 300 MHz can be shown in by curve 60 in FIG. 6. Curve 60 in FIG. 6 can reveal a maximum gain of nearly 5.7 dBi, which is only slightly greater than the gain of an ideal resonant monopole (5.15 dBi). Thus, the gain that is realized with an antenna of the present invention is about the same, but size of the antenna is physically about half the size (13 cm versus 25 cm) of the antenna of the prior art.

The simulation results shown reveal that the described design method can allow for a methodical designing/tuning of a coaxial leaky-wave monopole element such that it resonates at an arbitrary frequency. Furthermore, the input impedance of the leaky-wave monopole can be made to resemble that of a standard monopole while also retaining a similar radiation pattern.

C. Dipole Example

The design method for the coaxial leaky-wave element is general enough that it can readily be extended to the design of dipole elements. Predictably, a dipole version of the coaxial leaky-wave monopole could also be roughly double the length of the monopole version. Compensating for a shorter length by reducing the spiral pitch distance p of helical slot 18 can work to an extent. However, at some point, the linear relationship between phase and frequency that is observed with both the matching and leaky modes would eventually break down. Also, a difference in the design procedure is that in order to make the coaxial cavity have an apparent λ/2 length, the terminating end must be loaded with a perfect magnetic conductor, PMC (voltage maximum as opposed to a current maximum). Leaving the terminating end "open" can approximate this boundary condition. Still further, top-loading and bottom-loading may be necessary for the dipole alternative embodiments. This loading can serve the same purpose as in the monopole case, but additionally it can provide a small ground plane which can help to provide a way to balance the feed. A coaxial leaky-wave dipole is shown in FIG. 5. This particular dipole can have the same conductor diameter ratio d/D as the monopole example shown in FIG. 1, a length (analogous to height h of the monopole embodiments) of 26 cm (~λ/4 at 300 MHz), and top-loading plates 22, 24 with 3.5 cm radii.

Figure 7:
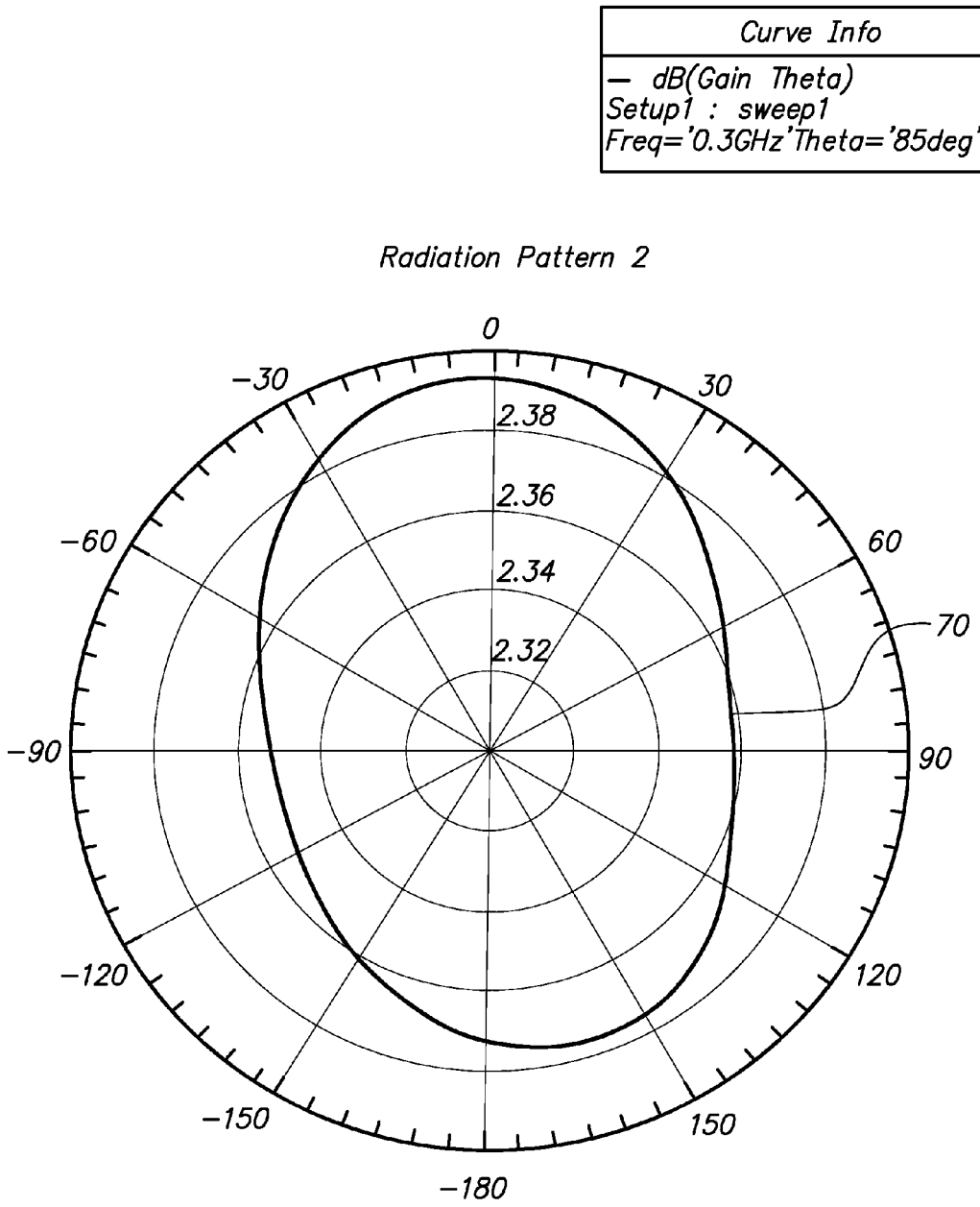
FIG. 7 is an azimuthal gain pattern for antenna of FIG. 5, when viewed in top plan.
Figure 12:
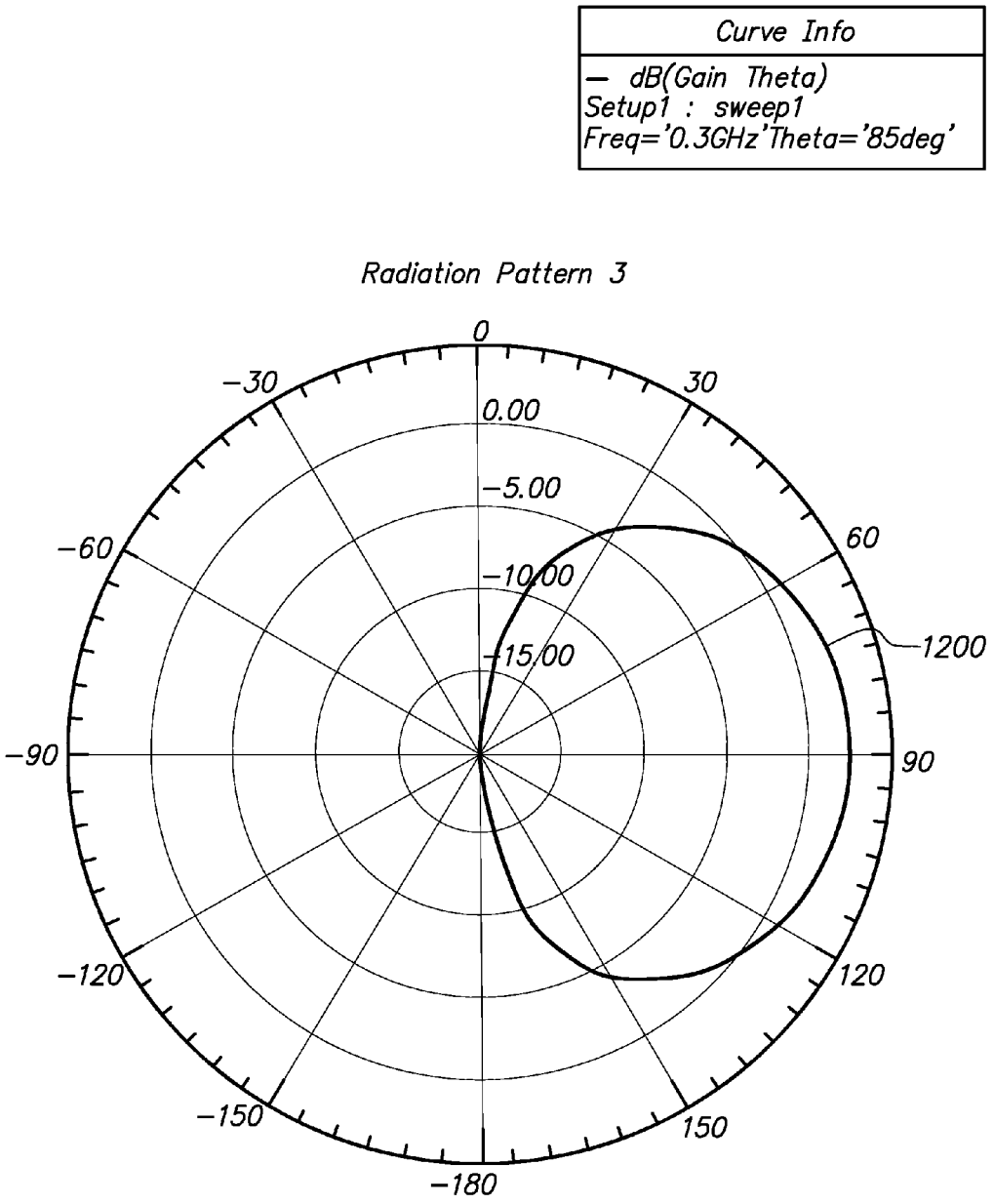

The azimuthal gain pattern for this dipole can be shown as curve 70 in FIG. 7. The side elevational gain pattern for the dipole can be seen from curve 1200 in FIG. 12. By referring to FIG. 7, it can be seen that the azimuthal gain of ~2.36 dBi can exceed that of the λ/2 thin dipole (2.14 dBi). However, the gain pattern is not perfectly omni-directional which may be due, in part, to the axial asymmetry of the leaky-wave dipole. However, this asymmetry does not seem to be apparent in the monopole gain pattern (See curve 60 in FIG. 6). The impedance comparison can reveal that the characteristic impedance of the waveguide (55Ω) could probably have been adjusted to achieve impedance closer to that of the standard dipole if so desired. What this example shows is that proposed design method for the leaky-wave monopole element can be readily extended towards the design of a dipole element and that the leaky-wave dipole exhibits similar far-field behavior as a standard dipole. A couple of advantages of this type of dipole can be that it is not center-fed (i.e., the dipole antenna can be fed from one end, in the same manner as a monopole antenna, which can be an improvement over the prior art) and that it can provide a reasonable means of setting up a balanced feed.

From the above, it can be seen that the antenna design methodology allows one to design an antenna that uses leakage current as the radiating mechanism. Though this is not a novel feature of the antenna, the design methodology allows one to set up the leakage current such that it resonates at a desired frequency and radiates in a desired manner. The antenna design can allow for more design variables than a standard monopole or dipole might have. Parameters such as pitch distance, waveguide characteristic impedance, and waveguide termination impedance can be used to improve the impedance match. Or, an intentional impedance mismatch can be imposed on the design, for increased broadband performance. The feed mechanism for the dipole antenna is identical to that of the monopole antenna. This is typically not the case for monopoles and dipoles. It provides a relatively easy way to feed the dipole antenna in a balanced way. Lastly, the design methodology is simple to apply and extremely methodical. It does requires little antenna designer insight or intuition.

For the materials of the present invention, inner conductor 16 and outer conductor 15 can be made of copper or other conductive material. For waveguide 20, air could be used; alternatively the waveguide 20 could be filled with a dielectric material such as Teflon®. For these embodiments, the user could have an additional design parameter when determining the waveguide characteristic impedance, i.e. the waveguide material. Furthermore, the use of Teflon® could allow the designer to have a surface upon which to wrap the outer conductor 15, presumably a thin metallic sheet, around. One aspect of the antenna design that was not discussed was the transition from the waveguide feed to the assumed feed mechanism, a coaxial transmission line. This can be done in a number of ways and be supported by electromagnetic (EM) fundamentals. Furthermore, the design methods of the present according to several embodiments can be amenable to application using commercially available computational electromagnetic (CEM) simulation software. One such exemplary software is the High Frequency Structure Simulator (HFSS) computer software, by Ansys®. However, other computer software programs could be used.

Figure 8:
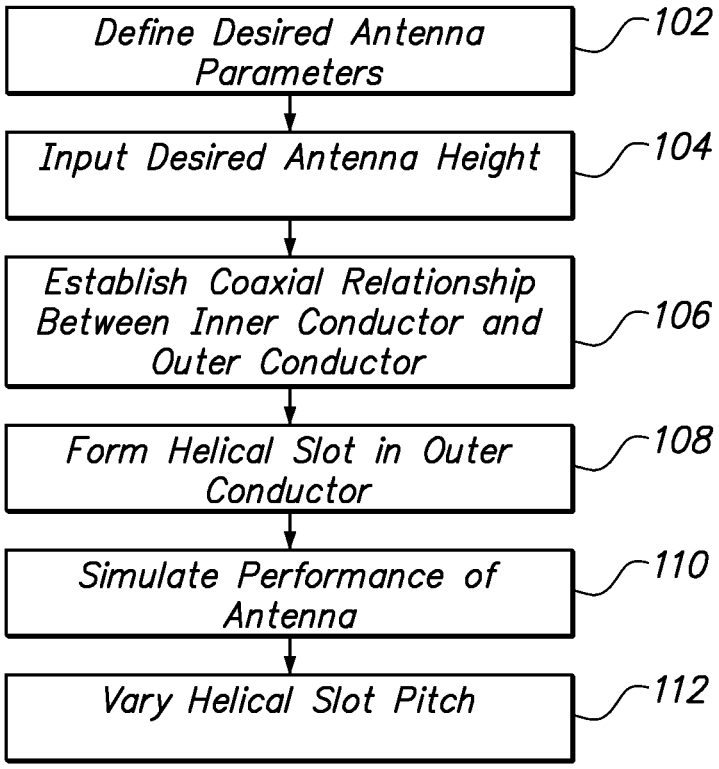
FIG. 8 is a block diagram, which illustrates steps that can be taken to practice the methods of the invention according to several embodiments.

Referring now to FIG. 8, a block diagram that can be used to illustrate the methods of the present invention is shown and is designated by reference character 100. As shown, method 100 can include the initial step 102 of defining the desired antenna parameters, such as radiation pattern, operating frequency, and the like (For the 300 MHz monopole example described above, the antenna height would normally be 25 cm). Next, the desired antenna height can be input (step 104). The desired height can usually be driven by the physical space available for the antenna; for example, if only 13 cm's are available, the 13 cm's can be input into the methods of the present invention according to several embodiments. As also shown in FIG. 8, the methods according to several embodiments can further include the step of establishing a coaxial relationship between an inner conductor 16 and an outer conductor 14 as shown by step 106. The accomplishment of step 106 can further establish the annular waveguide 20 described above.

Referring again to FIG. 8, the methods according to several embodiments can further include the step of forming a helical slot 18 in outer conductor 15, as indicated by step 108. The accomplishment of steps 106 and 108 can result in an antenna 10 that has a manufactured height that is less than the height of antennas of the prior art that are designed to the same frequency, but without any appreciate degradation in antenna performance. The methods according to several embodiments can further include the optional step 110 of simulating the antenna performance of the antenna resulting from step 108, using the simulation structure described above and shown in FIGS. 9 and 10. As shown in step 112, and optionally based on the simulation results of step 110, helical slot parameters of helical slot 18 can optionally be varied to maximize the performance of the antenna. To accomplish the aforementioned design methodology, commercially available computational electromagnetic (CEM) simulation software can be implemented.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An antenna comprising:

an inner conductor;

a metallic sheet arranged around said inner conductor in a coaxial arrangement to establish an outer conductor, said outer conductor cooperating with said inner conductor to form an annular waveguide cavity between said outer conductor and said inner conductor;

a first conductive disk located at a first end of said antenna;

a second conductive disk located at a second end of said antenna;

wherein a helical slot is formed in said outer conductor; and, wherein said antenna is feedable from one of said first end and said second end of said dipole antenna for both monopole and dipole operation.

2. The antenna of claim 1, wherein said helical slot has a pitch, wherein said antenna has a design length, and wherein said pitch is varied according to said design length.

3. A method for manufacturing an antenna, comprising the steps of:

A) defining antenna parameters of said antenna;

B) calculating an antenna height corresponding to said antenna parameters;

C) providing an inner conductor;

C1) wrapping a metallic sheet around said inner conductor to establish an outer conductor concentric to said inner conductor;

D) providing a first conductive disk at a first end of said dipole antenna;

E) providing a second conductive disk at a second end of said dipole antenna;

F) said wrapping step defining an annular cavity between said inner conductor and an outer conductor;

G) forming a helical slot in said outer conductor; and,

H) feeding said antenna is from the same one of said first end and said second end of said antenna for both monopole and dipole operation.

4. The method of claim 3, wherein said helical slot has a pitch, and further comprising the steps of:

I) simulating a performance of said antenna; and,

J) varying said pitch in said helical slot from said step G), according to the result of said step I).

* * * * *